US010327495B2

(12) United States Patent
Thalken

(10) Patent No.: US 10,327,495 B2
(45) Date of Patent: Jun. 25, 2019

(54) HEADGEAR FOR REDUCING HEAD TRAUMA

(71) Applicant: Jason Thalken, Seattle, WA (US)

(72) Inventor: Jason Thalken, Seattle, WA (US)

( * ) Notice: Subject to any disclaimer, the term of this patent is extended or adjusted under 35 U.S.C. 154(b) by 108 days.

(21) Appl. No.: 15/318,914

(22) PCT Filed: Jun. 17, 2015

(86) PCT No.: PCT/US2015/036184
§ 371 (c)(1),
(2) Date: Dec. 14, 2016

(87) PCT Pub. No.: WO2015/195771
PCT Pub. Date: Dec. 23, 2015

(65) Prior Publication Data

US 2017/0127747 A1 May 11, 2017

Related U.S. Application Data

(60) Provisional application No. 62/013,040, filed on Jun. 17, 2014.

(51) Int. Cl.
*A63B 71/10* (2006.01)
*A42B 3/04* (2006.01)
(Continued)

(52) U.S. Cl.
CPC ..... *A42B 3/0473* (2013.01); *A42B 3/046* (2013.01); *A42B 3/125* (2013.01); *A42B 3/283* (2013.01); *A63B 71/10* (2013.01)

(58) Field of Classification Search
CPC ..... A42B 3/0473; A42B 3/046; A42B 3/125; A42B 3/283; A63B 71/10
(Continued)

(56) References Cited

U.S. PATENT DOCUMENTS 2,785,404 A 3/1957 Elwood
5,123,408 A 6/1992 Gaines
(Continued)

OTHER PUBLICATIONS

Adam Bartsch et al., "Impact test comparisons of 20th and 21st century American football helmets", DOI: 10.3171/2011.9.JNS111059, pp. 1-12, Nov. 4, 2011.
(Continued)

*Primary Examiner* — Gloria M Hale
(74) *Attorney, Agent, or Firm* — Lempia Summerfield Katz LLC

(57) ABSTRACT

The disclosure provides embodiments for potentially reducing and/or preventing head trauma. Headgear apparatuses comprise a head-protection component configured to be worn over a head and to protect the head from an external force. In certain embodiments, the headgear apparatus has an effective mass of at least 5 kg. In other embodiments, the head-protection component is a form-fitting structure, wherein a maximum distance the head-protection component extends from an exterior surface of the head is less than 5 cm. The head-protection component may be interconnected with a neck support and a body support, wherein the head-protection component, the neck support, and the body support comprise a single structure made of a semi-flexible foam material coated in a latex or vinyl composition.

16 Claims, 18 Drawing Sheets

(51) Int. Cl.
*A42B 3/12* (2006.01)
*A42B 3/28* (2006.01)

(58) Field of Classification Search
USPC ..... 2/411, 414, 459, 421
See application file for complete search history.

(56) References Cited

U.S. PATENT DOCUMENTS

| | | | | |
|---|---|---|---|---|
| 6,000,066 | A | 12/1999 | Williams | |
| 6,421,840 | B1 | 7/2002 | Chen et al. | |
| 7,430,767 | B2 | 10/2008 | Nagely | |
| 7,703,152 | B2 * | 4/2010 | Rhodes | A42B 3/0473 2/421 |
| 8,834,394 | B2 * | 9/2014 | Ghajar | A61F 5/055 128/846 |
| 9,615,618 | B2 * | 4/2017 | Margetis | A42B 3/0473 |
| 2010/0088808 | A1 | 4/2010 | Rietdyk et al. | |
| 2011/0277225 | A1 | 11/2011 | Salkind et al. | |
| 2013/0031706 | A1 * | 2/2013 | Cooksey | A42B 3/0473 2/459 |
| 2014/0224849 | A1 * | 8/2014 | Hiemenz | A45F 3/04 224/271 |
| 2014/0237707 | A1 * | 8/2014 | Lane | A42B 3/125 2/414 |
| 2015/0164171 | A1 * | 6/2015 | Margetis | A42B 3/0473 2/6.6 |

OTHER PUBLICATIONS

PCT International Preliminary Report on Patentability dated Dec. 20, 2016 for corresponding PCT/US2015/036184.

PCT International Search Report and Written Opinion of the International Searching Authority dated Nov. 12, 2015 for corresponding PCT/US2015/036184.

* cited by examiner

HEADGEAR FOR REDUCING HEAD TRAUMA

CROSS-REFERENCE TO RELATED APPLICATIONS

The present patent document is a § 371 nationalization of PCT Application Ser. No. PCT/US2015/036184, filed Jun. 17, 2015, designating the United States, which is hereby incorporated by reference, and this patent document also claims the benefit of U.S. Provisional Patent Application No. 62/013,040, filed on Jun. 17, 2014, which is hereby incorporated by reference in its entirety.

FIELD

The following disclosure relates to the reduction and/or prevention of head trauma. More specifically, the following disclosure relates to potentially reducing and/or preventing head trauma with improved headgear.

BACKGROUND

Diffuse axonal injury (DAI) refers to extensive lesions in white matter tracts of the brain, and is a result of traumatic shearing or rotational forces that occur when the head is rapidly accelerated or decelerated.

Chronic traumatic encephalopathy (CTE) is a progressive degenerative disease that may develop in an individual with a history of multiple sub-concussive or concussive head injuries, or other forms of head injury having diffuse axonal injuries. CTE has been commonly found in athletes participating in American football, ice hockey, wrestling, and other contact sports who have experienced repetitive brain trauma. CTE has also been found in soldiers exposed to a blast or a concussive injury, in both cases resulting in characteristic degeneration of brain tissue and the accumulation of tau protein. CTE may develop from sub-concussive impacts, meaning that the diffuse axonal injuries involved were insufficient to result in a concussion, but nonetheless accumulate over time. Individuals with CTE may show symptoms of dementia, such as memory loss, aggression, confusion and depression, which may appear years or decades after the trauma.

The majority of conventional headgear, regardless of the sport being played, is composed of a combination of soft compressible material and a hard shell. Upon impact from an object (e.g., another player's helmet, body part, or a ball/puck), the soft material of the headgear may compress and absorb some of the energy, while the hard material may spread the impact energy out over the surface of the headgear shell and effectively increase the surface area. Such conventional headgear may be effective at protecting against types of injuries caused by localized tissue damage, thereby reducing the number of cuts, broken bones, bruises, skull fractures, etc.

Unfortunately, conventional headgear is not designed to prevent concussions or CTE. In fact, in 1974 the National Operating Committee on Standards for Athletic Equipment (NOCSAE) defined their set of safety standards for helmets/headgear using a "linear drop test." Such a test is involves fitting a headform with the helmet and dropping the headform onto an anvil from various orientations. The standard developed in 1974 has remained largely unchanged to date. While there is evidence to believe that helmets designed to according to the NOSCAE safety standard prevents the likelihood of a skull fracture, there is little reason to believe conventional headgear is effective at reducing incidences of concussions or CTE.

Therefore, there is a continued need for improved headgear to reduce an incident of a concussion or reduce the likelihood of developing CTE.

SUMMARY

The disclosure provides embodiments for potentially reducing and/or preventing head trauma. In one embodiment, the headgear apparatus comprises a head-protection component configured to be worn over a head and to protect the head from an external force, wherein the headgear apparatus has an effective mass of at least 5 kg. The head-protection component may be interconnected with a neck support and a body support, wherein the head-protection component, the neck support, and the body support comprise a single structure made of a semi-flexible foam material coated in a latex or vinyl composition.

In another embodiment, the headgear apparatus comprises a head-protection component configured to be worn over a head and to protect the head from an external force, wherein the head-protection component is a form-fitting structure, wherein a maximum distance the head-protection component extends from an exterior surface of the head is less than 5 cm. The head-protection component may be interconnected with a neck support and a body support, wherein the head-protection component, the neck support, and the body support comprise a single structure made of a semi-flexible foam material coated in a latex or vinyl composition.

BRIEF DESCRIPTION OF THE DRAWINGS

Exemplary embodiments are described herein with reference to the following drawings.

DETAILED DESCRIPTION

Figure 1:
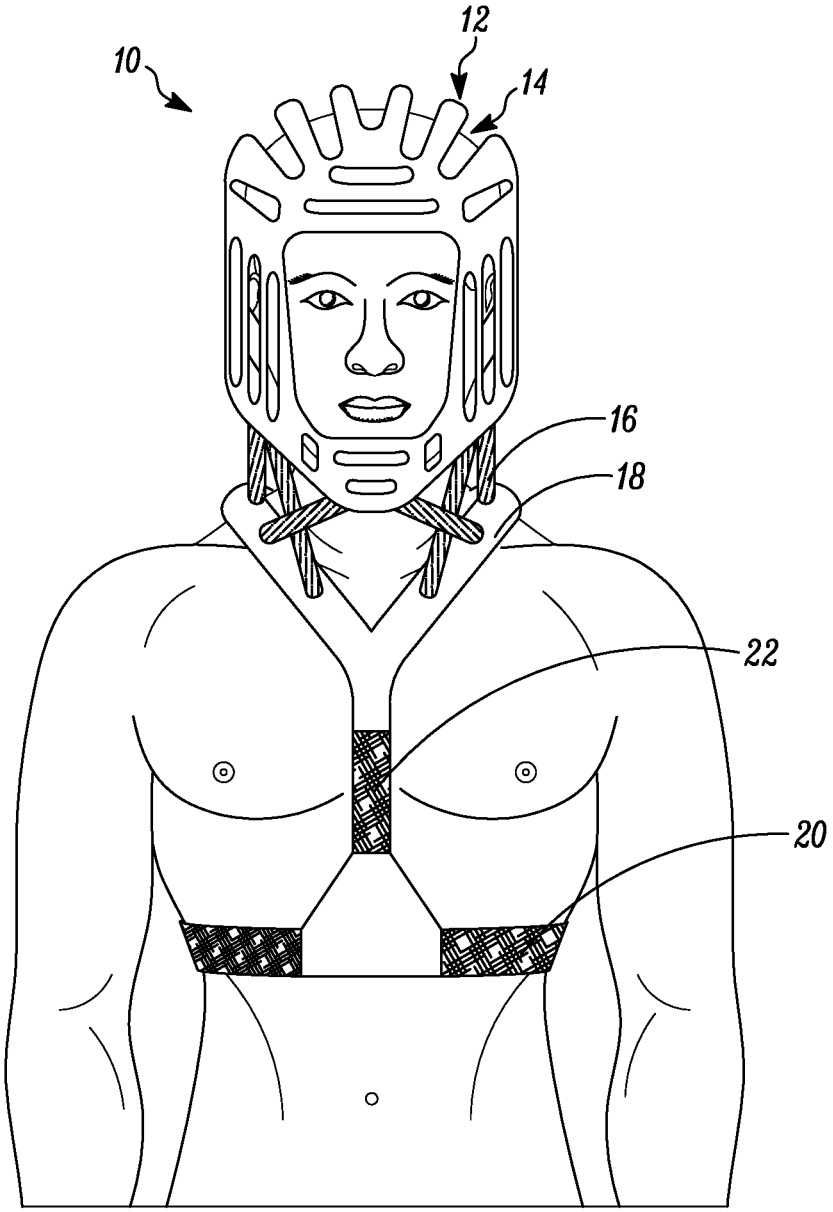
FIGS. 1, 2, and 3 illustrate an example of a headgear apparatus from a front, back, and side-profile, respectively, with the apparatus including a spring and harness connecting the headgear to the body.

Head trauma may be reduced or prevented by reducing the likelihood of a concussive event by reducing the amount of diffuse axonal injury (DAI) to the brain. In other words, the amount of rotation of the head following impact from an external force may be proportional to the magnitude of the stretching of axons on the brain. Therefore, the potential of DAI may be reduced by limiting the angular velocity of the head, $\omega_{head}$, following impact from an external object or force. The following embodiments include systems, apparatuses, and methods for reducing and/or limiting the angular velocity of the head with improved headgear.

As used herein, the terms "headgear" or "headgear apparatus" may refer to an apparatus including a helmet or head-protection component and, optionally, a neck and/or body support, as well as any connection or link between the helmet/head-protection component and the neck and/or body harness support components.

As used herein, the term "head-protection component" may refer to a helmet or padded protective hat configured to be worn over and to protect the head. As described herein, the head-protection component may be connected to or in communication with other components of a headgear apparatus, such as a neck or body support.

As used herein, the term "effective mass" may refer to the measured mass amount of the head-protection component of the headgear apparatus, and, optionally, a percentage of the overall body mass of the wearer of the headgear apparatus. For instance, when the head-protection component of the headgear apparatus is connected to a neck support and/or body harness, the neck and/or body support may distribute the overall mass of the device to the neck/body. In such embodiments, the effective mass of the headgear apparatus is a function of the rigidity of the neck and/or body support connection to the head-protection component. For example, a more rigid connection effectively connects or adds a larger percentage of the body mass of the wearer into the headgear apparatus. That is, a completely rigid support connection may allow for 100% of the wearer body mass to be added to the headgear apparatus. In other embodiments, a less than completely rigid support connection between the head-support component and the neck and/or body support may import a percentage of the body mass of the wearer (e.g., at least 5%, at least 10%, at least 20% of the body mass, etc.) into the headgear apparatus.

Angular Velocity of the Head, $\omega_{head}$

The ability of a helmet or headgear to protect against diffuse axonal injury is related to the ability to reduce the head's final angular velocity, $\omega_{head}$, following impact. Angular velocity may be determined based on calculating the angular momentum generated on impact ($L_{impact}$). Angular momentum is a function of the momentum transferred to the head on impact ($P_{impact}$) and the distance of the impact from the center of rotation of the head ($R_{impact}$):

$$L_{impact}=R_{impact}\times\rho_{impact} \tag{1}$$

where "X" represents the cross-product of the momentum and distance, accounting for both the magnitude and direction of the impact.

The center of rotation of the head is at the base of the skull, where the head meets the neck. In certain embodiments, the rotational axis of the head is along the longitudinal axis between the top of the head and the neck or spine, where the head longitudinally rotates to its side (left or right) at a joint below the skull ("left/right rotation"). In other embodiments, the rotational axis of the head is a lateral axis between the left and right shoulders of the body, where the head rotates laterally rotates away from the midline of the body and moves toward the left or right shoulder at a joint below the skull ("side/side rotation"). In yet other embodiments, the rotational axis of the head is between the back and front of the neck, where the head extends up toward the sky or down towards the ground at a joint below the skull ("up/down rotation"). In some embodiments, the severity of the head trauma or diffuse axonal injury may vary based upon the rotational direction of the head following impact (e.g., up/down, left/right, or side/side rotation).

Angular momentum may also be expressed in terms of the angular velocity and the moment of inertia, $I_{head}$:

$$L_{impact}=\omega_{head}*I_{head} \tag{2}$$

where $I_{head}$ is the rotational equivalent of mass, and defined as the sum of the mass of each particle of the head, $m_{head}$, multiplied by the distance of each particle from the axis of rotation squared, $r_{head}^2$. In certain embodiments, the moment of inertia may also include each particle of the headgear, and the distance each particle of headgear is from the axis of rotation squared.

Equations (1) and (2) may be combined to solve for the angular velocity, where $I_{head}$ includes both the head and the headgear:

$$\omega_{head}=\frac{R_{impact}\times\rho_{impact}}{\sum m_{head}*r_{head}^2+\sum m_{headgear}*r_{headgear}^2} \tag{3}$$

It may be observed from equation (3) that the mass of the headgear or helmet is inversely proportional to the overall angular velocity. In other words, heavier headgear apparatuses may reduce the angular velocity of an impact, potentially reducing the chance for a concussion or CTE. It may also be observed from equation (3) that the distance the headgear extends from any of the rotational axes ($R_{impact}$) is directly proportional to the overall angular velocity. In other words, helmets or headgear that extends too far from any of the rotational axes may have higher angular velocities upon impact from an external force, potentially increasing the chance for a concussion or CTE. For example, headgear having a conventional football-type facemask that extends away from the left/right axis may increase the chance for a concussion or CTE over headgear without a facemask.

Headgear Apparatuses

In certain embodiments, head trauma may be reduced or prevented by limiting the amount of angular velocity of the head from an external force. In certain embodiments, head trauma may be reduced or prevented by limiting the amount of angular velocity of the head from an external force. For example, the amount of angular velocity may be limited or reduced by: (1) limiting the maximum distance the headgear apparatus extends from at least one axis of rotation, (2) increasing the mass of the headgear apparatus, or (3) a combination of (1) and (2).

In some embodiments, based on form-fitting headgear and/or increased mass headgear, the angular velocity may be limited or reduced by at least 10%, at least 20%, at least 30%, at least 40%, at least 50%, at least 60%, or at least 70% over a conventional headgear apparatus (e.g., an apparatus extending farther from an axis of rotation or a similarly shaped apparatus having a lower overall mass).

Form-Fitting Headgear

In certain embodiments, angular velocity (and potential head trauma) may be limited or reduced by limiting the maximum distance of the headgear apparatus from at least one axis of rotation of the head, at least two axes of rotation of the head, or all three axes of rotation of the head. The headgear apparatus may be "form-fitting" to the exterior of the head, providing a tight fit with the skull. In some embodiments, the maximum thickness of the headgear (i.e., the distance between the interior surface of the headgear and the exterior surface of the headgear as measured in a perpendicular direction from the interior and exterior surfaces) is less than 10 cm. In some embodiments, the maximum thickness of the headgear is less than 5 cm, 3 cm, 2 cm, or 1 cm. In certain embodiments, the maximum thickness of the headgear is between 0.1 cm and 10 cm, between 0.1 cm and 5 cm, between 0.1 cm and 3 cm, between 0.1 cm and 2 cm, or between 0.1 cm and 1 cm.

The headgear apparatus may also be described as form-fitting based upon the maximum distance the headgear apparatus extends from the exterior surface of the head. In some embodiments, the maximum distance between the exterior surface of the headgear and the exterior surface of the head is less than 10 cm, less than 5 cm, less than 3 cm, less than 2 cm, or less than 1 cm.

In some embodiments, the headgear apparatus may include a facemask or faceguard. The maximum distance between the facemask or faceguard and an exterior surface of the head may be less than 10 cm, less than 5 cm, less than 3 cm, less than 2 cm, or less than 1 cm.

Increased Mass Headgear

In certain embodiments, angular velocity may be reduced by increasing the overall mass of a headgear apparatus. In some embodiments, the mass of the headgear apparatus may be increased in the head-protection component or helmet itself. For example, the head-protection component may have an increased mass of at least 0.5 kg, at least 1 kg, at least 2 kg, at least 3 kg, at least 4 kg, at least 5 kg, or at least 10 kg. The mass of the headgear apparatus may be increased by adding at least one weight to the surface of the head-protection component. In other embodiments, at least one weight may be added to an internal location of the head-protection component. In yet other embodiments, added mass may be distributed throughout the head-protection component.

In other embodiments, the head-protection component of the headgear apparatus may be connected to a neck support and/or body harness. The neck and/or body support, and any connections between the head-protection component and the neck/body support may provide additional mass, which may distribute additional mass from the neck and/or body to the device. In such embodiments, the headgear apparatus may have an effective mass that is greater than conventional headgear. The effective mass of the headgear apparatus is a function of the rigidity of the neck and/or body support connection to the head-protection component. Additionally, connection of the head-protection component of the headgear apparatus to a neck and/or body support may ease the stress felt by the external impact as the neck and/or body become involved in the rotation.

For example, a more rigid connection effectively connects or adds more of the body mass of the wearer into the headgear apparatus. That is, a completely rigid support connection may allow for 100% of the wearer body mass to be added to the headgear apparatus. In some embodiments, such a rigid connection may allow for the center of rotation of the impact to shift away from the head and into the torso, which may limit or alleviate any diffuse axonal injury whatsoever.

In other embodiments, a less than completely rigid support connection between the head-support component and the neck and/or body support may import a percentage of the body mass of the wearer (e.g., at least 5%, at least 10%, at least 20% of the body mass, etc.) into the headgear apparatus. Such a semi-rigid or flexible connection may create a headgear apparatus having an effective mass of at least 5 kg, at least 10 kg, at least 20 kg, at least 30 kg, at least 50 kg, or at least 75 kg. Such a semi-rigid or flexible connection may also allow for improved field of vision for the wearer (in comparison to a completely rigid connection) while still reducing the angular velocity of an impact below any measurable injury threshold.

In some embodiments, the headgear apparatus may comprise a combination of both increased mass in the head-protection component, as well as a connection between the head-protection component and a neck or body harness support.

Headgear Materials and Construction

The head-protection component of the headgear apparatus may be comprised of any number of materials. In some embodiments, the head-protection component includes a rigid layer such as a plastic, rubber polymer, carbon fiber, aluminum, wood, or a combination thereof. Alternatively, the head-protection component may have a semi-rigid or flexible layer such as a plastic, latex, vinyl, or combination thereof. The rigid, semi-rigid, or flexible layer may comprise the outermost layer of the head-protection component.

The head-protection component may include at least one interior layer of material between the outermost, exterior layer and the head. In some embodiments, the interior layer is made of a soft foam or compressible material to provide comfort to the wearer of the headgear, as well as a cushion or shock absorption from an outside force or impact.

In certain embodiments, the head-protection component includes cut-outs or vents that provide breathability, visual, and/or auditory capabilities for the wearer. The vents and cutouts may be of varying sizes and shapes. For example, the face of the headgear is cutout or exposed around the eyes, nose, and mouth allowing the wearer to see and breathe without obstruction. In some embodiments, cutouts are located around the ears to allow the wearer of the headgear to hear without obstruction. In other embodiments, vents or cutouts may be located around the top or sides of the head to allow the wearer to vent heat and sweat generated from the head to a location outside the headgear.

In some embodiments, the head-protection component may include at least one weight affixed to the head-protection component to increase the mass of the headgear apparatus. The weight(s) may be provided on the exterior of the head-support component, or interior of the outer layer of the head-support component. For example, a weight (e.g., a 0.5 kg, 1 kg, 2 kg, 3 kg, 4 kg, 5 kg, or 10 kg weight) may be provided on a rear location of the head-protection component near the base of the component (and close to the neck when worn). The weight may be secured to the head-protection component by at least one screw or bolt through the weight and into the head-protection component. In other embodiments, the weight may be secured through supporting straps or connectors (e.g., a rigid steel support) extending from the weight around the surface of the head-protection component. In certain embodiments, the weight may be covered by a protective padding.

In certain embodiments, external attachments on the head-protection component may be "artificial vertebrae" elements that resemble the backbone or spine. The artificial vertebrae may include several individual elements interconnected with each other and connected to the surface of the head-protection component. The artificial vertebrae may extend around the circumference of the head-protection component from the top of the head-protection component to the bottom (near the chin). The artificial vertebrae may also extend in a semi-circle from an area near one ear to an area near the other ear. In some embodiments, the artificial vertebrae elements may extend from near the top of the head-protection component down the back of the head-protection component to a neck support, and in some embodiments, to a body support (e.g., harness).

The artificial vertebrae may comprise a combination of rigid, semi-rigid, or flexible components such as a hard rubber, nylon, or polymeric material. The artificial vertebrae may comprise wood, plastic, or a carbon fiber. The vertebrae elements may be interconnected via rigid, semi-rigid, or flexible links or spring supports such as steel rods covered by a padding material (e.g., rubber). The vertebrae elements may be connected to or in communication with the head-protection component via a clamping mechanism (e.g., a bolt and screw combination). The clamping mechanism may be adjustable to loosen or tighten the angle of the connection.

In yet other embodiments, the head-protection component may include at least one shock absorber configured to dissipate or damp a shock impulse and convert kinetic energy into another form of energy (e.g., thermal). The at least one shock absorber may be a pneumatic or a hydraulic shock absorber. In certain embodiments, the at-least one shock absorber may be positioned on the exterior of the head-protection component. For example, one shock absorber may be positioned on the rear surface of the head-protection component and connect the head-protection component with a neck or body support.

In some embodiments, the headgear apparatus includes at least two or at least three shock absorbers. For example, a headgear apparatus may include three shock absorbers having (1) a first absorber designed to reduce or absorb the shock from an external force along the x-axis, (2) a second absorber designed to reduce or absorb the shock from an external force along the y-axis, and (3) a third absorber designed to reduce or absorb the shock from an external force along the z-axis.

As discussed above, the head-protection component may be connected to or in communication with a neck support or body support for added support and weight. In some embodiments, the head-protection component may be connected to or in communication with a neck support, which itself may be connected to or in communication with a body support.

The neck and/or body support may be made of similar or different materials as the head-protection component. The neck support may be a neck harness or collar extending at least partially around the circumference of the neck. In some embodiments, the neck support extends around the entire circumference of the neck, and may be fitted on the wearer's body by slipping the neck support over the head through an opening in the center, or by securing multiple portions of the neck support together by at least one releasable attachment (e.g., buckle, clasp, or other securing mechanism). The neck support may have weights secured to the neck support in chosen locations to increase the overall weight of the headgear apparatus.

The body support may be a body harness that secures the headgear apparatus to the torso of the body. The harness may include at least one body circumference strap extending around the circumference of the body. The body circumference strap may include a releasable attachment and/or an adjustable feature to loosen or tighten the strap to fit against the torso. The body harness may include at least one shoulder strap extending from one location of the body circumference strap to a second location of the body circumference strap. The at least one shoulder strap may include an adjustment feature or releasable attachment to loosen or tighten the strap to fit against the torso. In certain embodiments, the circumference and shoulder straps may be made from a flexible or semi-rigid material such as nylon.

In some embodiments, the head-protection component is connected to or in communication with a neck or body support via at least one rigid, semi-rigid, or flexible connector. Rigid connectors may provide strong structural support and stability between the head-protection component and the neck or body support. Semi-rigid or flexible connectors may provide some level of structural support or stability while adding improved motion or degrees of freedom for the head. In certain embodiments, the connector may be semi-rigid or flexible in its static state, and may transition into a rigid state upon a triggering event. The triggering event may be a motion or shock sensor positioned within the headgear apparatus that senses an upcoming impact or reacts to an impact.

The at least one connector may be a coiled or semi-coiled spring, which itself may be covered in a protective coating (e.g., a cloth or rubber coating).

In other embodiments, the at least one connector may be a "duck bill" or substantially flat and elongated component extending from the base of the head-protection component near the back of the head to a receptor secured to the back torso of the body by a body harness. The duck bill may be made from a rigid or semi-rigid material such as wood, plastic, or a carbon fiber. The receptor may include an internal cavity to receive the duck bill connector to restrict the degree of lateral (left/right), vertical (up/down), or horizontal (shoulder/shoulder) movement of the head. For example, presuming that a person has 180 degrees of movement of the head from left to right, 180 degrees of the movement of the head from up to down, and 180 degrees of movement from shoulder to shoulder, the receptor and duck bill connector may restrict at least one, at least two, or all three axes of rotation by at least 10% and less than 90%. In some embodiments, the motion is restricted in at least one, at least two, or all three axes of rotation to a degree of movement between 5%, 10%, 20%, or 30% and less than 40%, 50%, 60%, 70%, 80%, or 90% of the unrestricted degree of movement. In other embodiments, the motion is restricted in at least one, at least two, or all three axes of rotation between 5, 10, 20, or 30 degrees of movement and 50, 60, 70, 80, or 90 degrees of movement.

Figure 2:
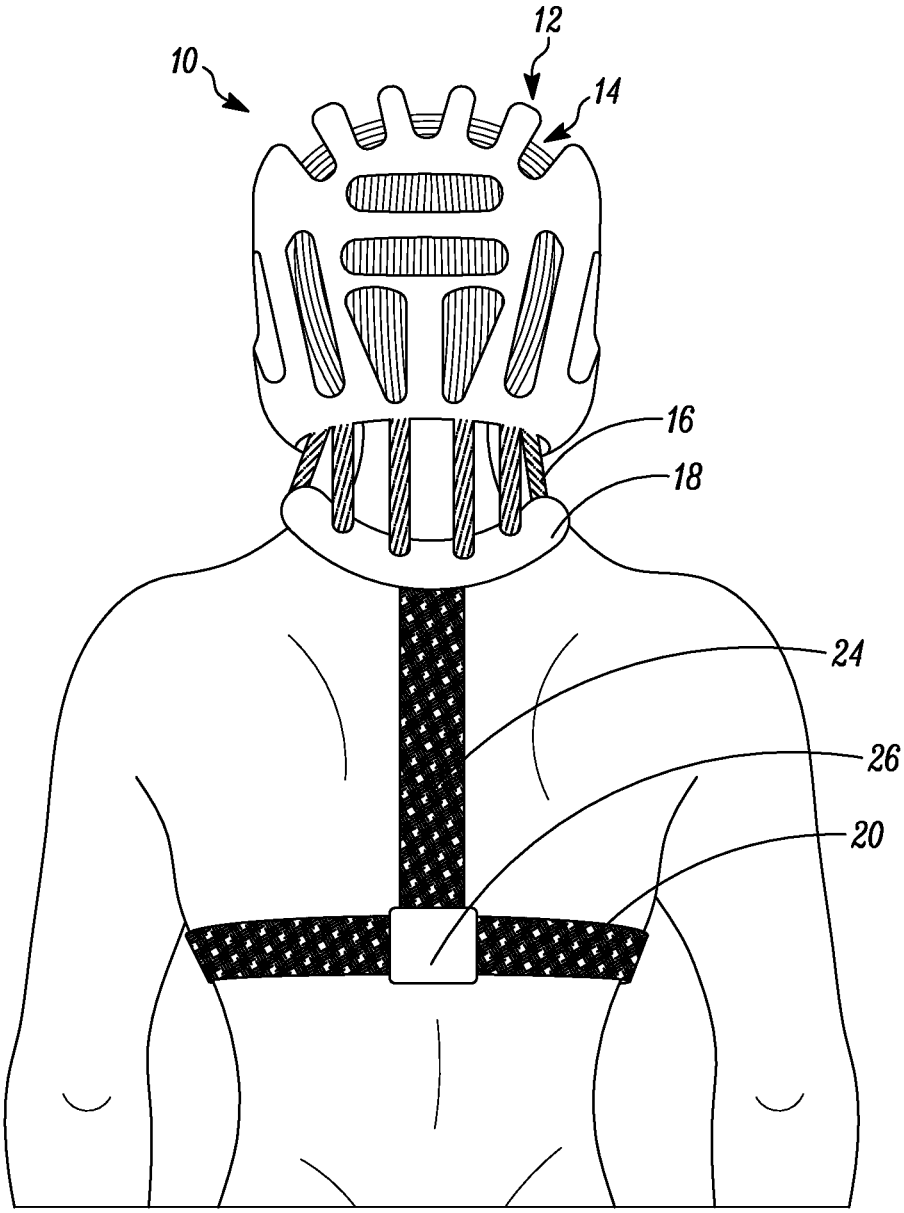
Figure 3:
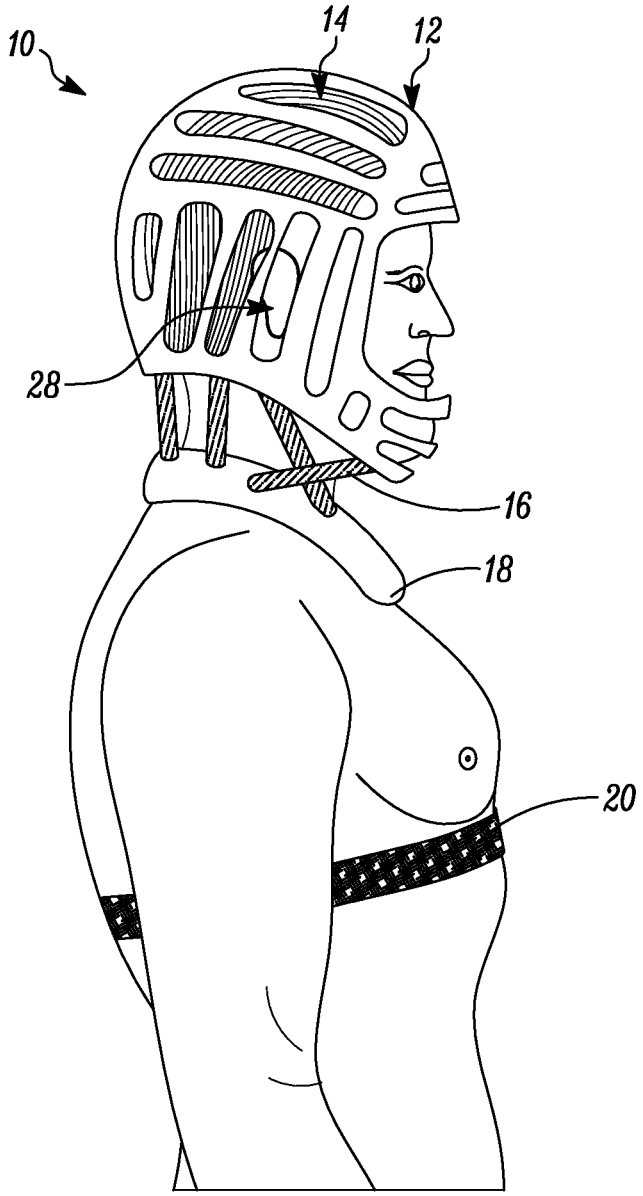

FIGS. 1-18 illustrate non-limiting examples of the headgear apparatus features described above. FIGS. 1, 2, and 3 illustrate an example of a headgear apparatus 10 from a front, back, and side-profile, respectively. In FIGS. 1, 2, and 3, the headgear apparatus 10 includes a head-protection component 12 having vents 14 or openings within the component. Certain openings in the head-protection component may function as ear holes 28. The head-protection component 12 may include an interior padding and an exterior shell composed of a rigid plastic, carbon fiber, or aluminum composition. The head-protection component 12 is connected to a neck brace 18 or harness via a semi-coiled spring 16. The spring 16 includes a protective coating such as a cloth or rubber material. Like the head-protection component 12, the neck brace 18 may include an interior padding and an exterior shell composed of a rigid plastic, carbon fiber, or aluminum composition. The neck brace 18 is connected to a body support or harness 20 via a front link 22 and back link 24. The body harness 20 also includes a buckle 26 or connector to join and adjust portions of the body harness around the body.

Figure 4:
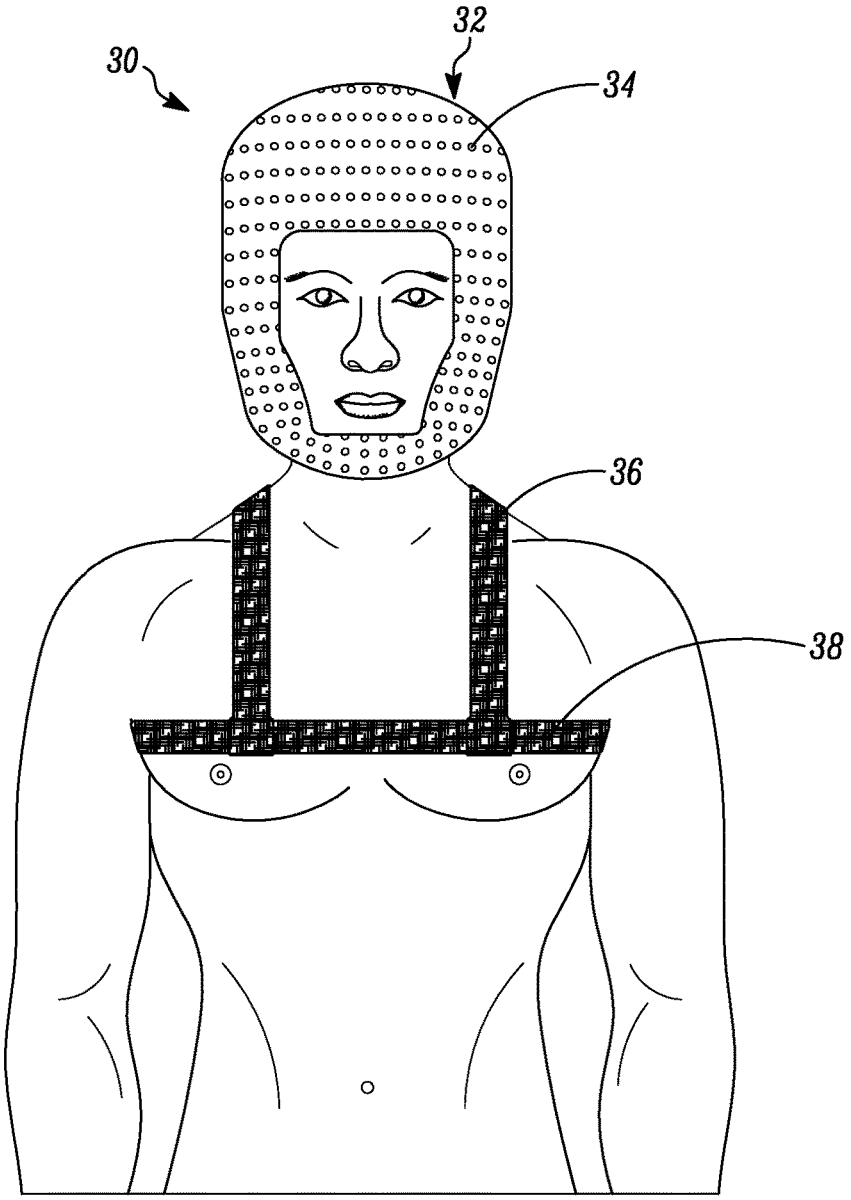
FIGS. 4, 5, and 6 illustrate an example of a headgear apparatus from a front, back, and side-profile, respectively, with the apparatus including a rigid headgear, a body harness support, and a "duck bill" component in communication with the rigid headgear and body harness support.
Figure 5:
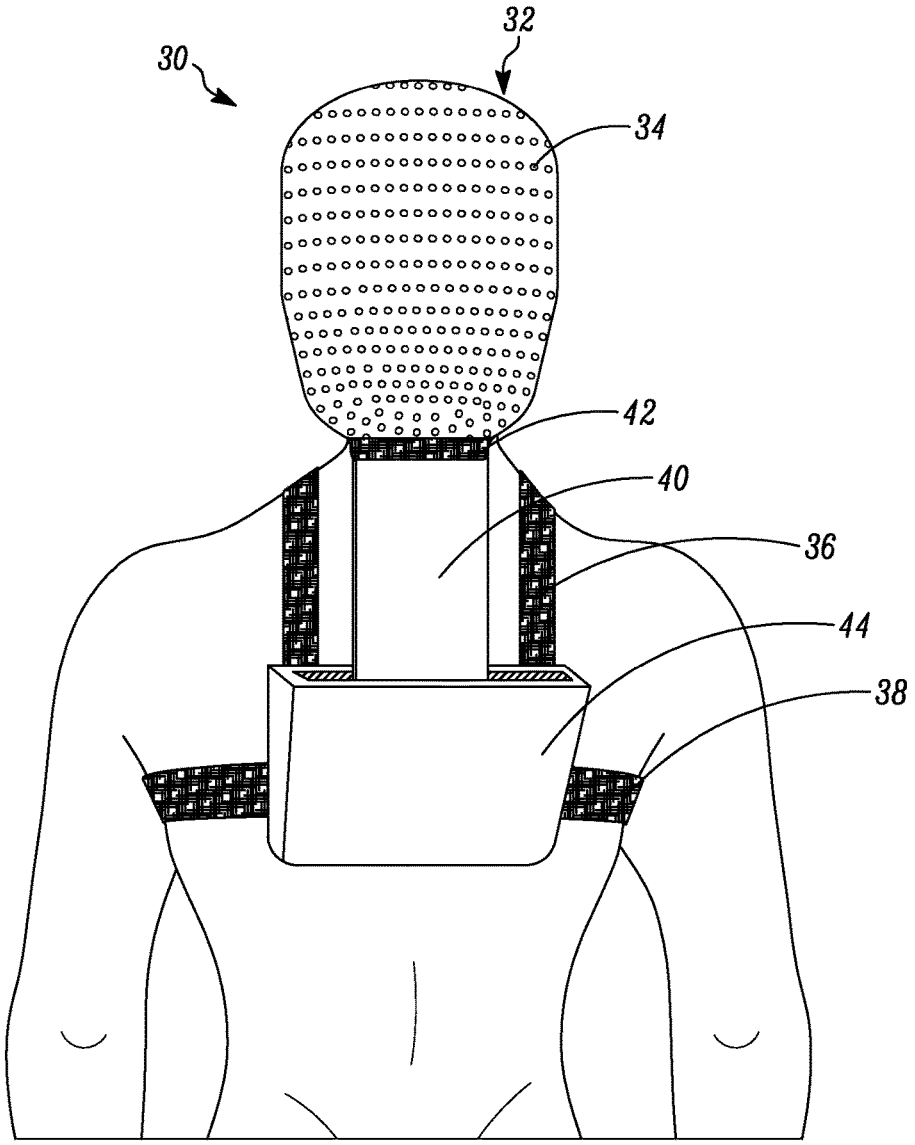
Figure 6:
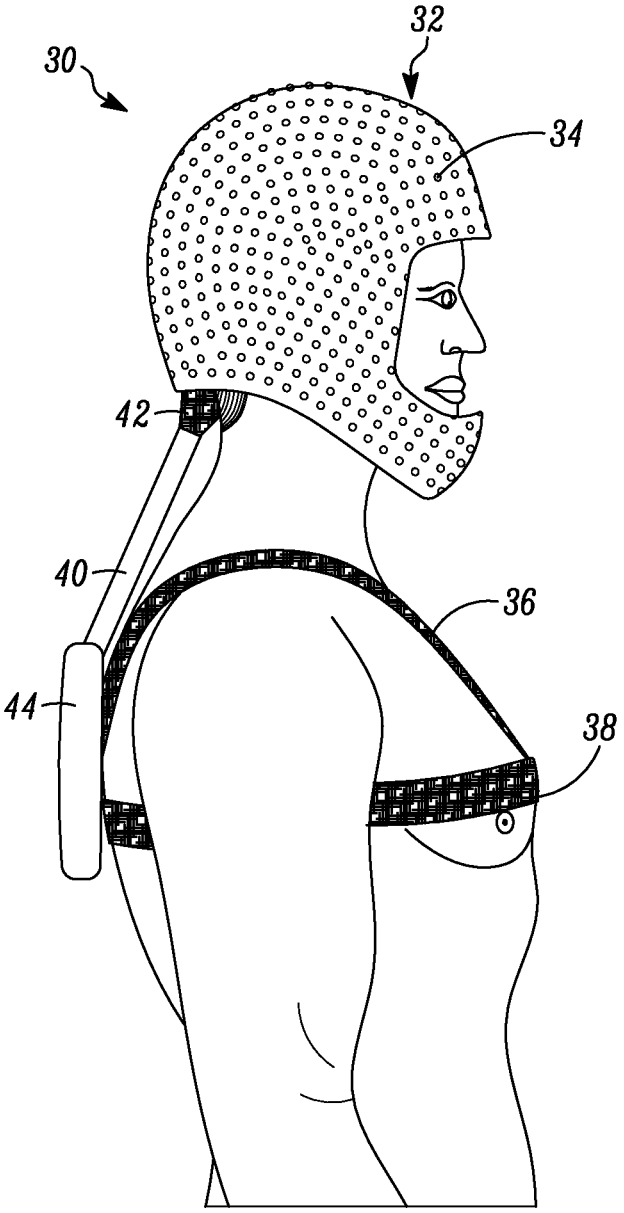

FIGS. 4, 5, and 6 illustrate an example of an additional headgear apparatus 30 from a front, back, and side-profile, respectively. In FIGS. 4, 5, and 6, the headgear apparatus 30 includes a head-protection component 32 having vents 34 or openings within the component. The head-protection component 32 is connected to or in communication with shoulder harnesses 36 and a body harness 38 via a duck bill 40. The duck bill 40 is a substantially flat and elongated component extending from the base 42 of the head-protection component near the back of the head to a receptor 44 secured to the back torso of the body by a body harness. The duck bill may be made from a rigid or semi-rigid material such as wood, plastic, or a carbon fiber. The receptor 44 includes an internal cavity to receive the duck bill connector to restrict the degree of lateral (left/right), vertical (up/down), or horizontal (shoulder/shoulder) movement of the head.

Figure 7:
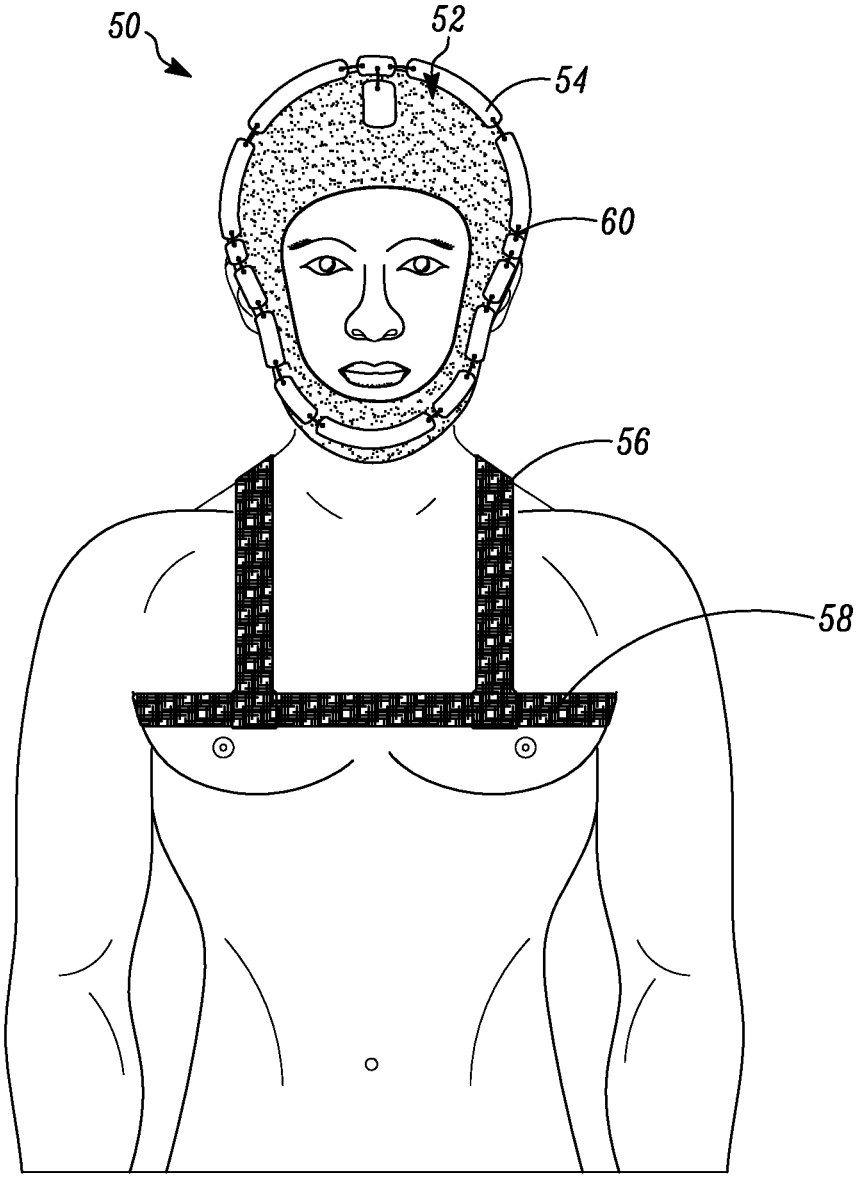
FIGS. 7, 8, and 9 illustrate an example of a headgear apparatus from a front, back, and side-profile, respectively, with the apparatus including a headgear having artificial vertebrae, a body harness support, and a connection between the headgear and body harness support.
Figure 8:
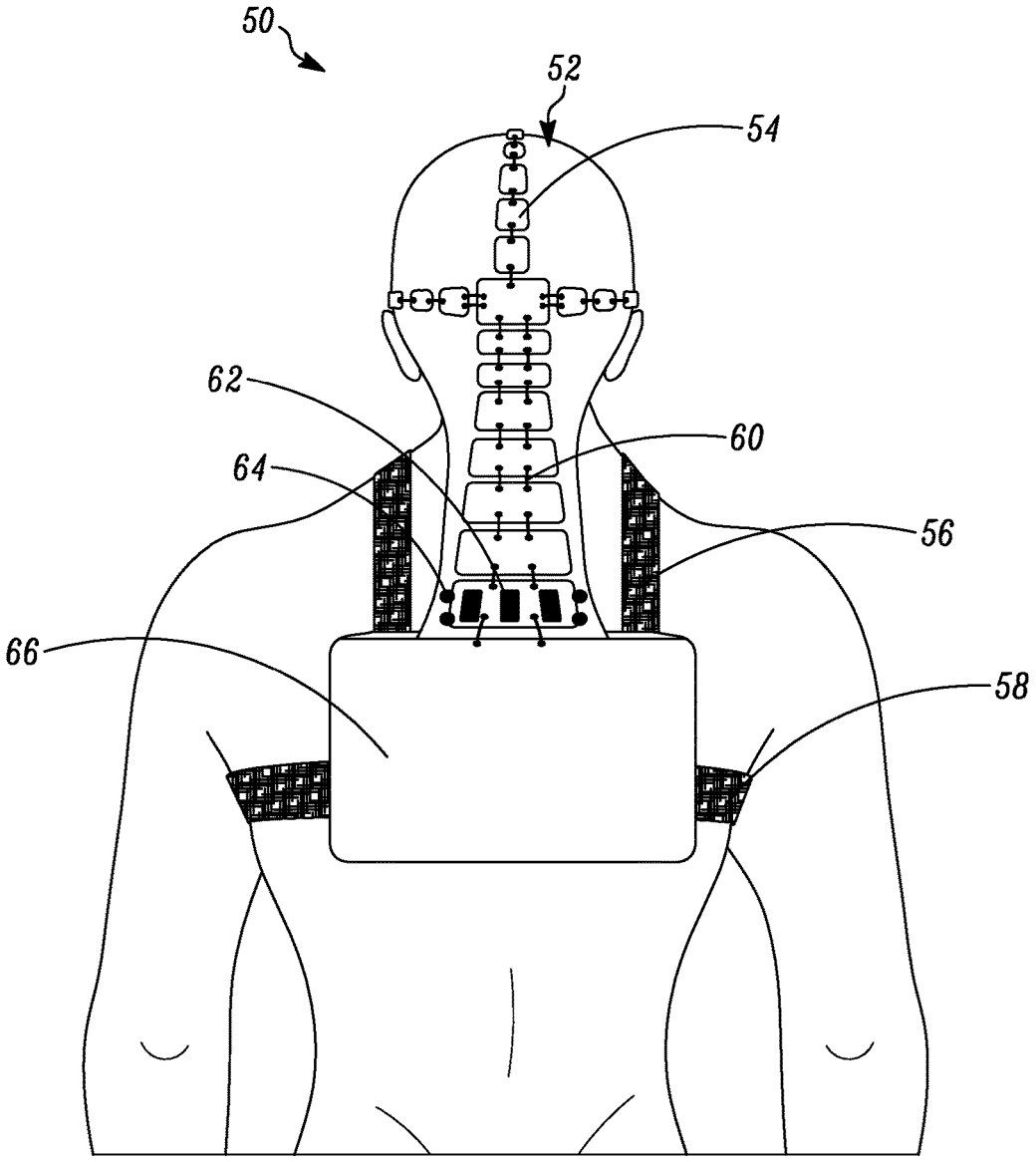
Figure 9:
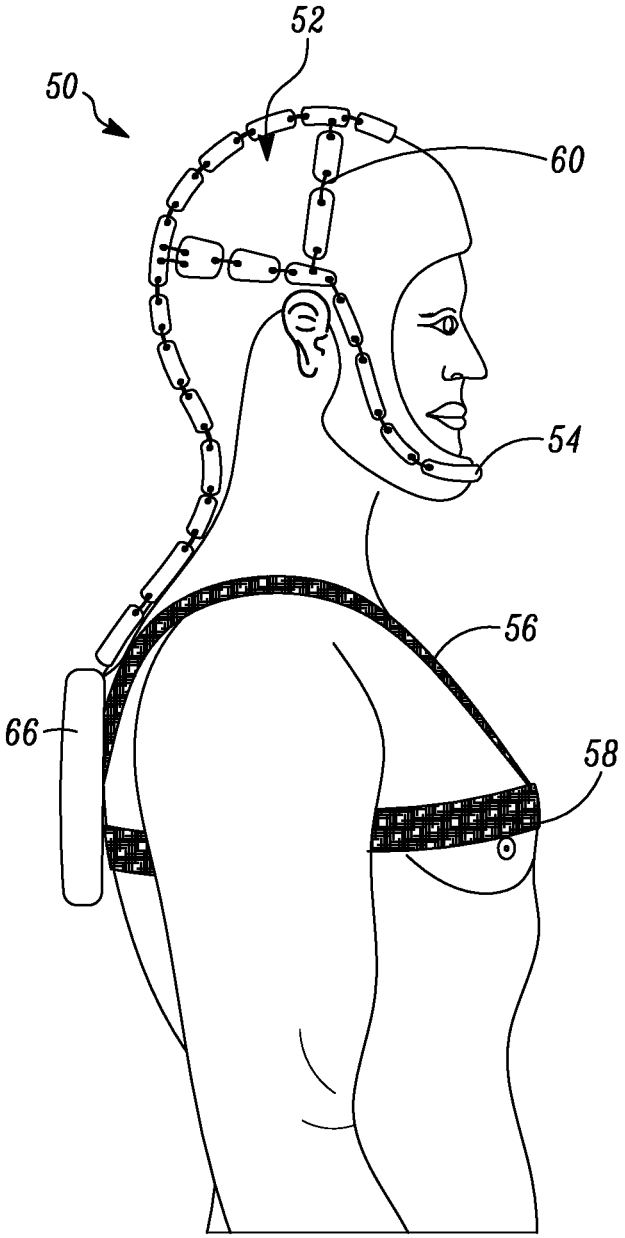

FIGS. 7, 8, and 9 illustrate an example of another headgear apparatus 50 from a front, back, and side-profile, respectively. In FIGS. 7, 8, and 9, the headgear apparatus 50 includes a head-protection component 52. The head-protection component 52 includes artificial vertebrae elements 54 that resemble the backbone or spine. The artificial vertebrae 54 are interconnected with each other via links 60 or spring supports such as steel rods covered by a padding material (e.g., rubber). The vertebrae 54 may also be connected to the surface of the head-protection component 52 via screws or clamps 64. The artificial vertebrae elements are connected to a receptor 66 secured to a body harness 58 having shoulder straps 56. The artificial vertebrae 54 include a combination of rigid, semi-rigid, or flexible components 62 encased within the vertebrae such as a hard rubber, nylon, or polymeric materials.

Figure 10:
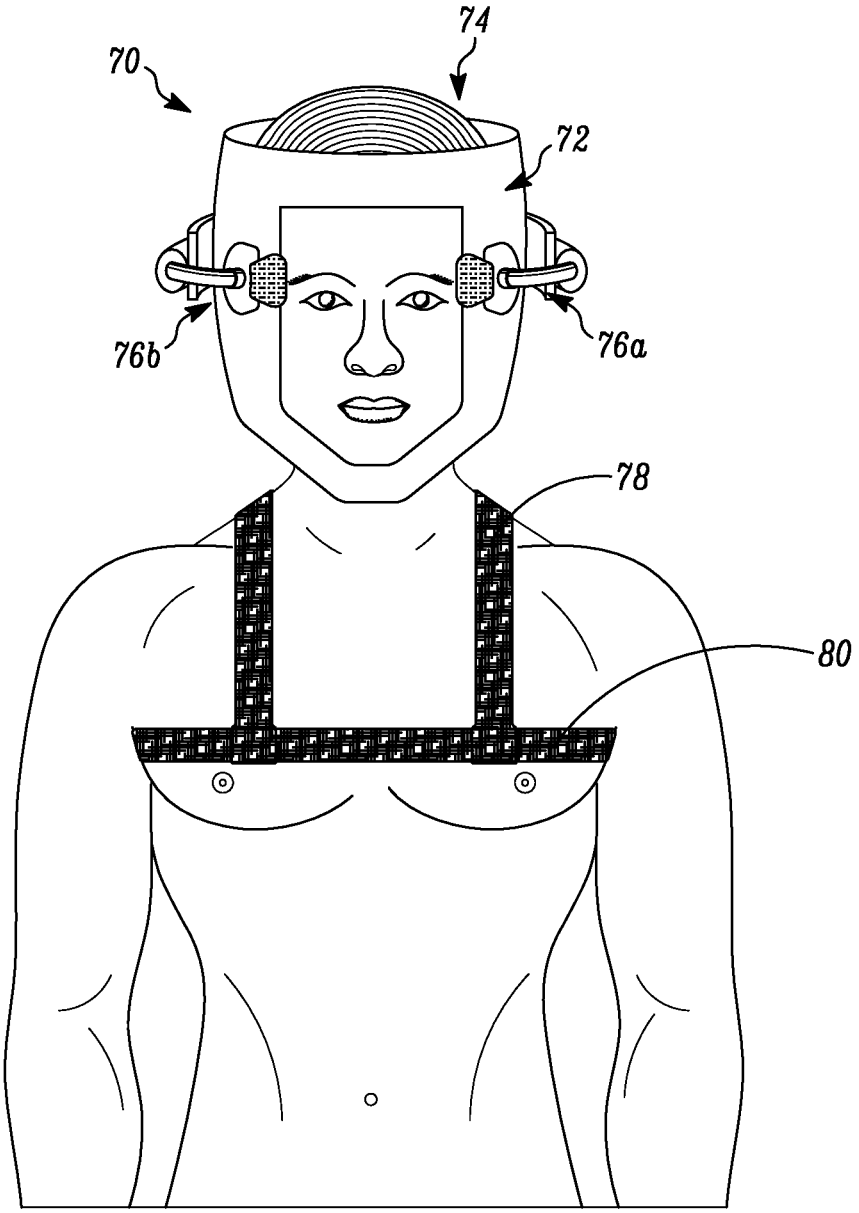
FIGS. 10, 11, and 12 illustrate an example of a headgear apparatus from a front, back, and side-profile, respectively, with the apparatus including a headgear having shock absorber components for reducing impact forces along the x and y axes, a body harness support, and a connection between the headgear and body harness support, where the connection includes a shock absorber component for reducing impact forces along the z-axis.
Figure 11:
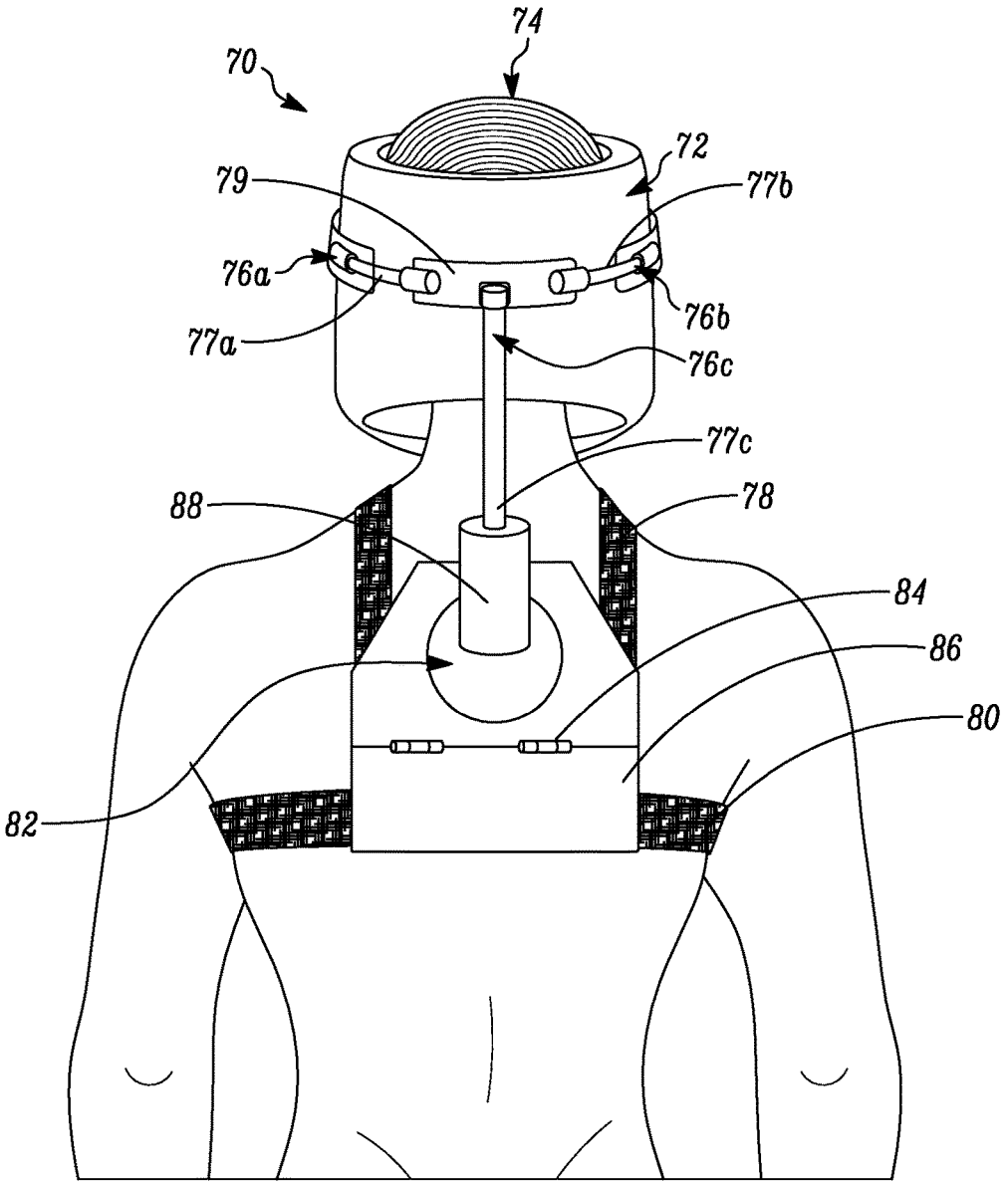
Figure 12:
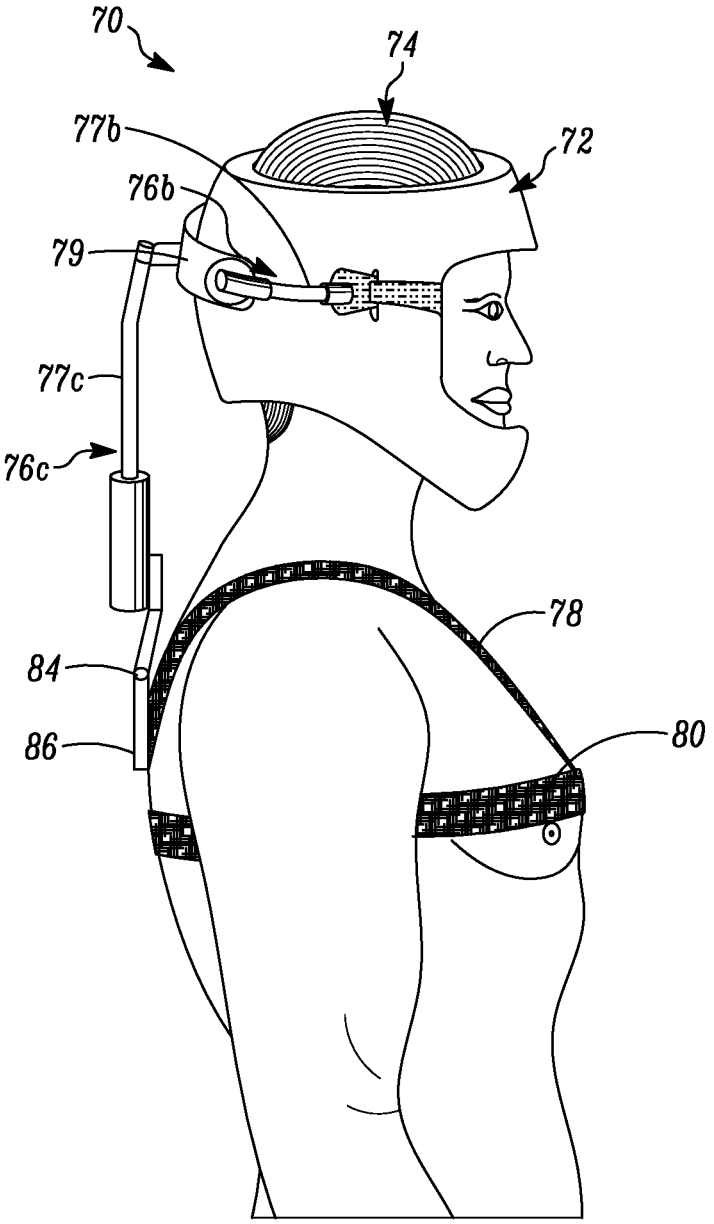

FIGS. 10, 11, and 12 illustrate an example of an additional headgear apparatus 70 from a front, back, and side-profile, respectively. In FIGS. 10, 11, and 12, the headgear apparatus 70 includes a head-protection component 72 having a vent 74 or opening near the top of the component for breathability. The headgear apparatus 70 includes three shock absorber apparatuses 76*a*, 76*b*, 76*c* configured to reduce or absorb the shock from external forces along the x-, y-, and z-axes. The three shock absorber apparatuses 76*a*, 76*b*, 76*c* are interconnected to a base 79, which itself is not itself connected to the head-protection component 72. The shock absorber apparatuses 76*a*, 76*b*, 76*c* include pistons 77*a*, 77*b*, 77*c* and absorbers 88. The absorbers 88 are in communication with a circular pivot 82. Shock absorber apparatus 76*c* is also connected to a body harness 80 having shoulder straps 78 via a base 86 and hinge 84 connection.

Figure 13:
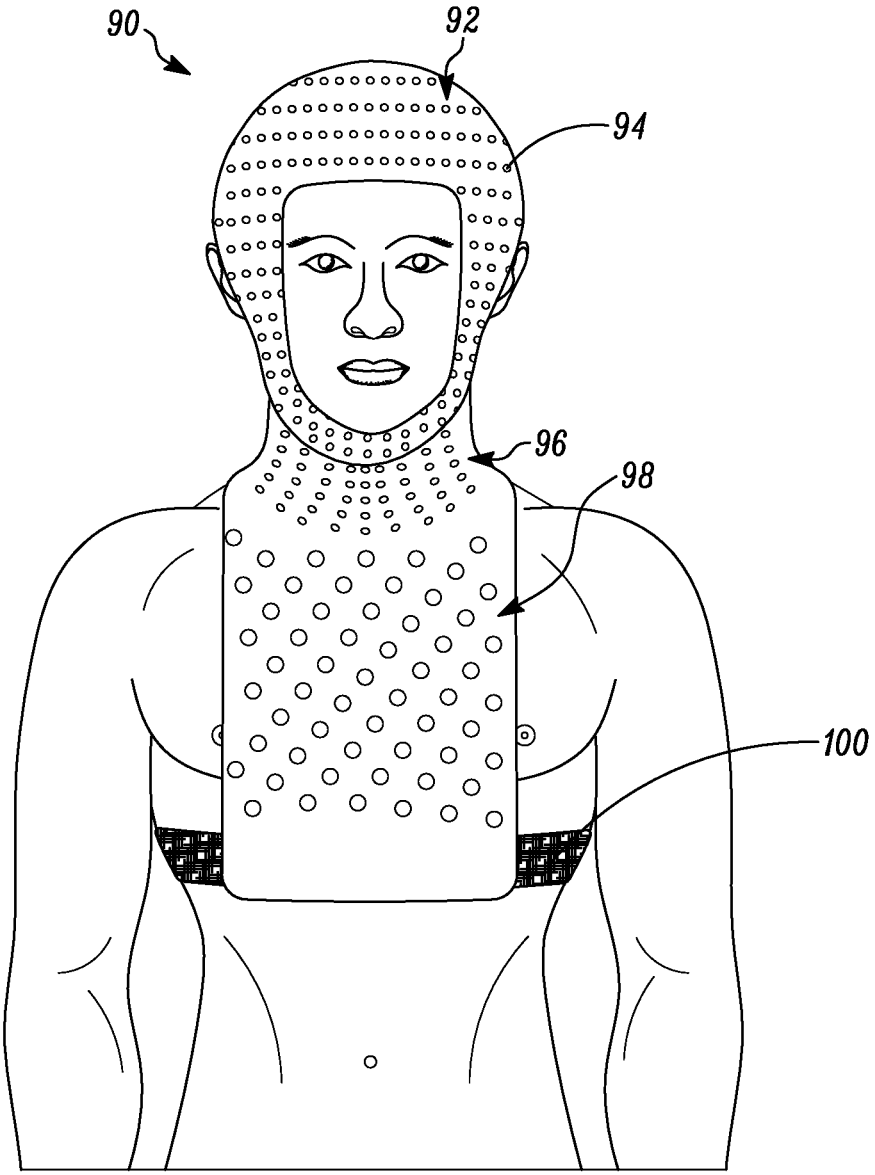
FIGS. 13, 14, and 15 illustrate an example of a headgear apparatus from a front, back, and side-profile, respectively, with the apparatus including a flexible or semi-rigid head/neck-gear combination and a body harness.
Figure 14:
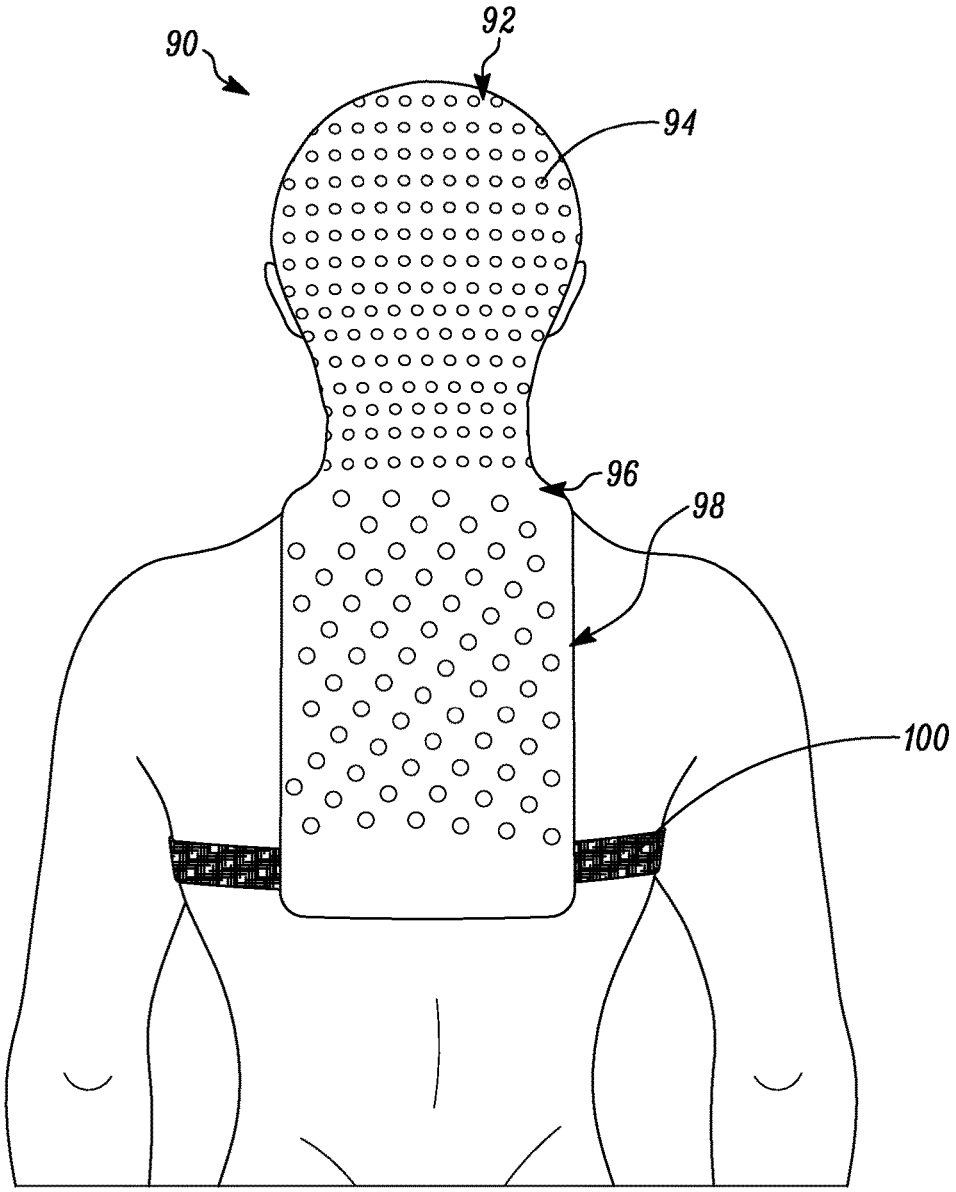
Figure 15:
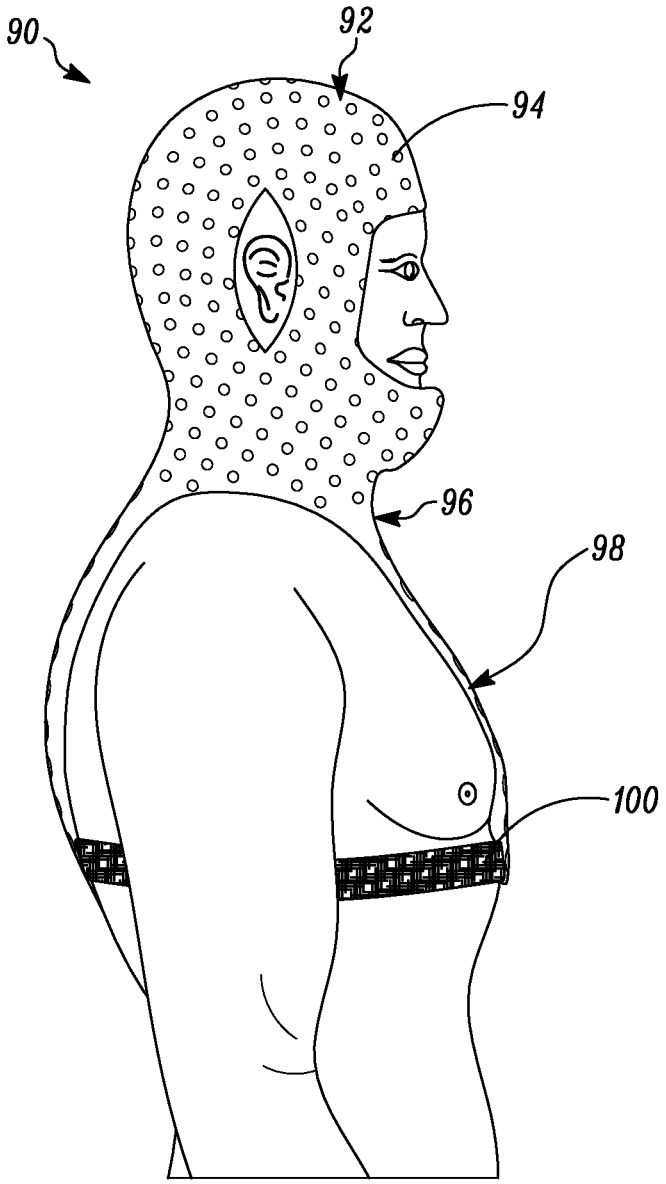

FIGS. 13, 14, and 15 illustrate another example of a headgear apparatus 90 from a front, back, and side-profile, respectively. In FIGS. 13, 14, and 15, the headgear apparatus 90 includes a single, interconnected apparatus having a head-protection component 92, a neck support 96, and a body support 98. The neck support 96 is configured to fit securely around the neck. The head-protection component 92, neck support 94, and body support 98 are made of a semi-flexible foam coated in a latex or vinyl composition. The headgear apparatus is designed with vents 94 or openings throughout for breathability. Certain openings in the head-protection component 92 may function as ear holes 102. The headgear apparatus 90 is also secured around the body with a body harness 100, which is attached to the base of the body support 98.

Figure 16:
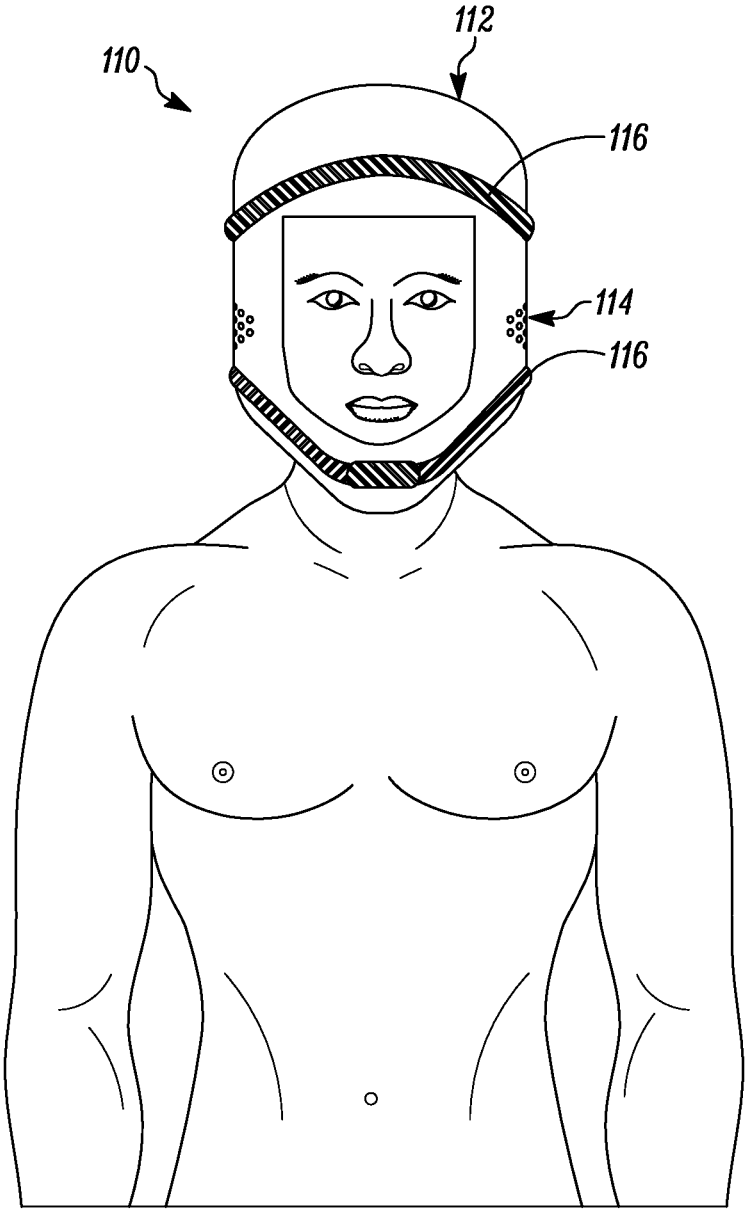
FIGS. 16, 17, and 18 illustrate an example of a headgear apparatus from a front, back, and side-profile, respectively, with the apparatus including a heavy-weight headgear and rigid support components and weight fastener.
Figure 17:
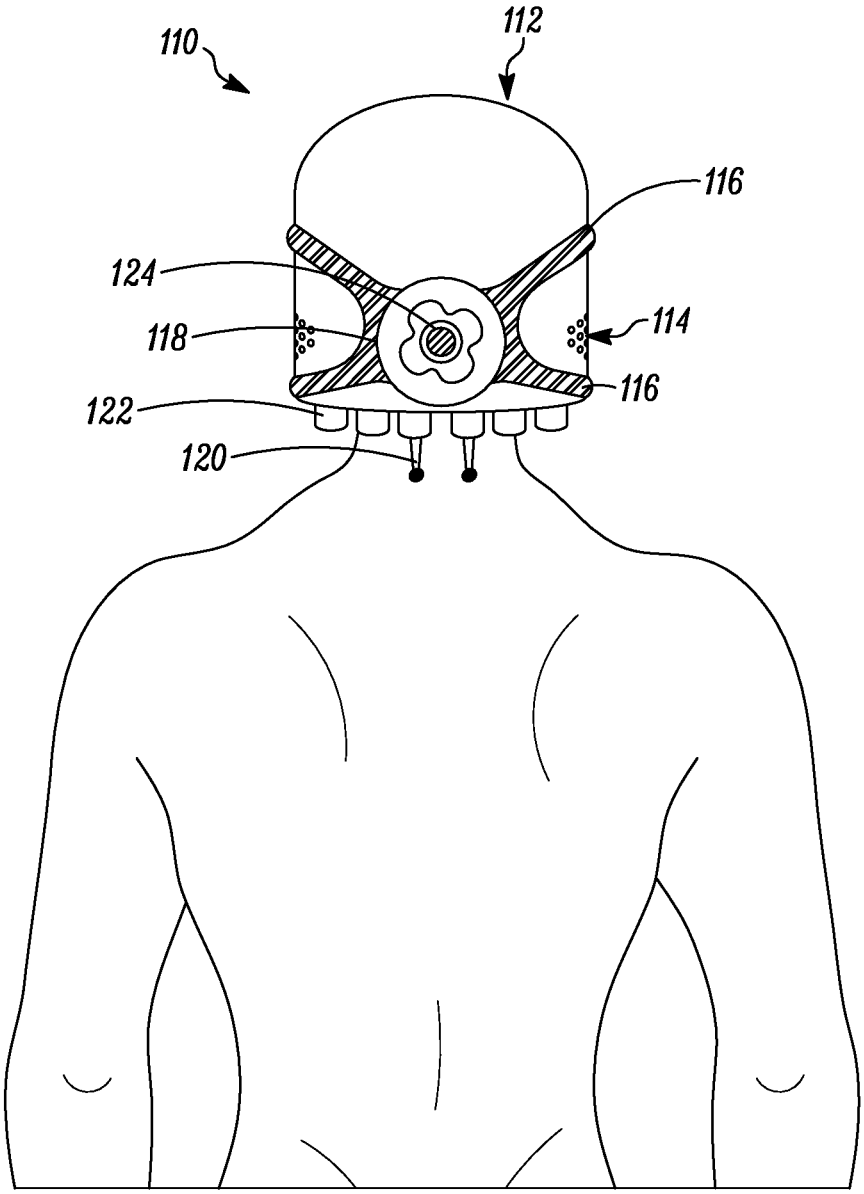
Figure 18:
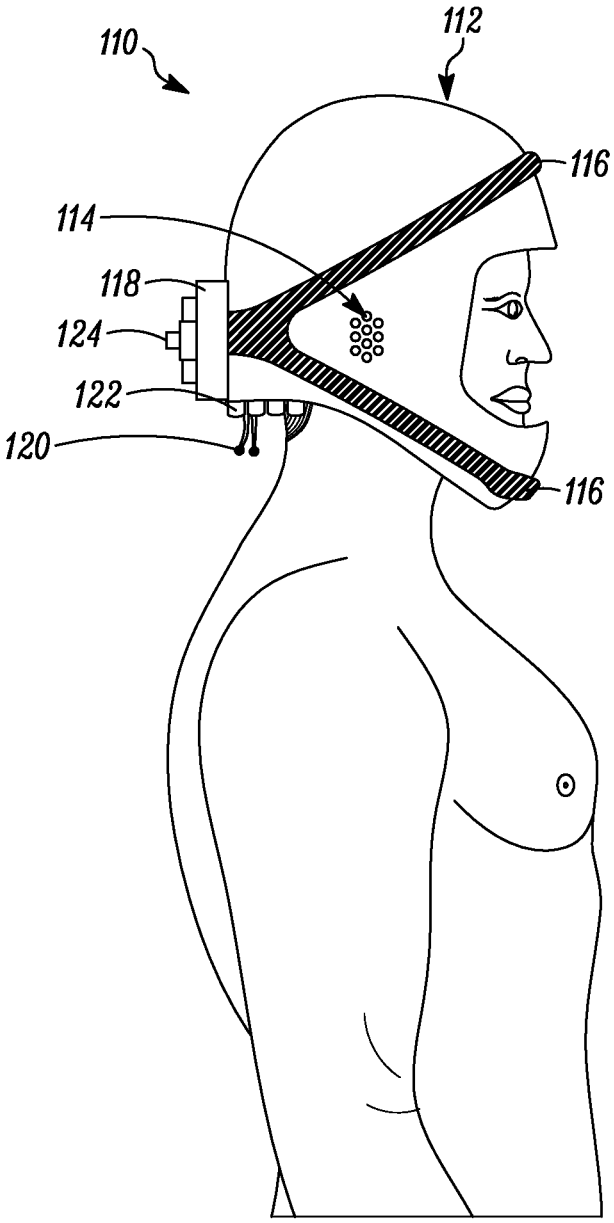

FIGS. 16, 17, and 18 illustrate an example of a headgear apparatus 110 from a front, back, and side-profile, respectively. In FIGS. 16, 17, and 18, the headgear apparatus 110 includes a head-protection component 112 having vents 114 or openings within the component. The vents 114 may function as ear holes. The head-protection component 112 includes a rigid or semi-rigid exterior and an interior foam padding 122. The head-protection component 112 also includes a weight component near the rear of the head-protection component. The weight component is comprised of a weight 118, a weight fastener 124, and rigid supports 116. The weight fastener 124 and rigid supports 116 assist securing the weight 118 to the head-protection component 112. The head-protection support 112 also includes pull strings 120 near the rear of the component configured to tighten and loosen the apparatus to the head.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

As used herein, the singular forms "a," "an," and "the" include plural referents unless the context clearly dictates otherwise.

As used herein, "for example," "for instance," "such as," or "including" are meant to introduce examples that further clarify more general subject matter. Unless otherwise expressly indicated, such examples are provided only as an aid for understanding embodiments illustrated in the present disclosure, and are not meant to be limiting in any fashion. Nor do these phrases indicate any kind of preference for the disclosed embodiment.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A headgear apparatus comprising:

a head-protection component configured to be worn over a head and to protect the head from an external force;

a neck support; and a body support, wherein the head-protection component is connected to the neck support, the body support, or the neck support and the body support via at least one connector, wherein the at least one connector is flexible or semi-rigid in a static state and is configured to transition into a rigid state upon a triggering event, and wherein the headgear apparatus has an effective mass of at least 5 kg when worn by a wearer, wherein the effective mass comprises a mass of the headgear apparatus and at least a portion of a body mass of the wearer.

2. The headgear apparatus of claim 1, wherein the head-protection component comprises at least one weight affixed to an external surface of the head-protection component, an internal surface of the head-protection component, or the external surface and the internal surface of the head-protection component.

3. The headgear apparatus of claim 2, wherein the at least one weight is affixed to the head-protection component with a securing device, wherein the securing device is a weight fastener, rigid support extending around a circumference of the head-protection component, or the weight fastener and the rigid support.

4. The headgear apparatus of claim 1, wherein the head-protection component comprises at least one shock absorber configured to dampen a shock impulse from the external force.

5. The headgear apparatus of claim 4, wherein the at least one shock absorber is a pneumatic shock absorber or a hydraulic shock absorber.

6. The headgear apparatus of claim 4, wherein the at least one shock absorber is positioned on a rear surface of the head-protection component and is connected to the neck support or the body support.

7. The headgear apparatus of claim 1, wherein the head-protection component comprises: (1) a first shock absorber configured to dampen a shock impulse from the external force along a x-axis, (2) a second shock absorber configured to dampen the shock impulse from the external force along a y-axis, and (3) a third shock absorber configured to dampen the shock impulse from the external force along a z-axis.

8. The headgear apparatus of claim 7, wherein the first shock absorber, the second shock absorber, and the third shock absorber are each independently a pneumatic shock absorber or a hydraulic shock absorber.

9. The headgear apparatus of claim 7, wherein the first shock absorber, the second shock absorber, or the third shock absorber is positioned on a rear surface of the head-protection component and is connected to the neck support or the body support.

10. The headgear apparatus of claim 1, wherein the at least one connector is a coiled spring or a semi-coiled spring.

11. The headgear apparatus of claim 1, wherein the headgear apparatus comprises a motion sensor or a shock sensor for monitoring the external force, and the triggering event is a change in a measurement of the motion sensor or the shock sensor.

12. A headgear apparatus comprising:

a head-protection component configured to be worn over a head and to protect the head from an external force;

a neck support; and a body support, wherein the head-protection component is connected to the neck support, the body support, or the neck support and the body support via at least one connector, wherein the at least one connector is a flat, elongated component connected to and extending from a base of the head-protection component, wherein the flat, elongated component is in communication with a receptor harness configured to be positioned on a back torso of a body, wherein the receptor harness comprises a rectangular internal cavity configured to receive a portion of the flat, elongated component and restrict lateral movement, vertical movement, and horizontal movement of the head, and wherein the headgear apparatus has an effective mass of at least 5 kg when worn by a wearer, wherein the effective mass comprises a mass of the headgear apparatus and at least a portion of a body mass of the wearer.

13. The headgear apparatus of claim 12, wherein the lateral movement is restricted between 5 degrees of movement and 50 degrees of movement, the vertical movement is restricted between 5 degrees of movement and 50 degrees of movement, and the horizontal movement is restricted between 5 degrees of movement and 50 degrees of movement.

14. A headgear apparatus comprising:

a head-protection component configured to be worn over a head and to protect the head from an external force;

a neck support;

a body support; and a plurality of artificial vertebrae, wherein the head-protection component is connected to the neck support, the body support, or the neck support and the body support via the plurality of artificial vertebrae, wherein a first portion of the plurality of artificial vertebrae is connected to an external surface of the head-protection component, and a second portion of the plurality of artificial vertebrae extends from the head-protection component and connects with the neck support or the body support, wherein the plurality of artificial vertebrae is interconnected via rigid, semi-rigid, or flexible links, and wherein the headgear apparatus has an effective mass of at least 5 kg when worn by a wearer, wherein the effective mass comprises a mass of the headgear apparatus and at least a portion of a body mass of the wearer.

15. The headgear apparatus of claim 14, wherein the links are steel rods covered by a protective padding material.

16. The headgear apparatus of claim 1, wherein the head-protection component is a form-fitting structure, and wherein a maximum distance the head-protection component extends from an exterior surface of the head is less than 5 cm.

* * * * *